US010470581B2

(12) United States Patent
Cimadamore

(10) Patent No.: US 10,470,581 B2
(45) Date of Patent: Nov. 12, 2019

(54) CONVERTIBLE FURNITURE ITEM

(71) Applicant: HSIGN S.r.l., Monte Giberto (FM) (IT)

(72) Inventor: Anna Luisa Cimadamore, Fermo (IT)

(73) Assignee: HSIGN S.R.L., Monte Giberto (FM) (IT)

( * ) Notice: Subject to any disclaimer, the term of this patent is extended or adjusted under 35 U.S.C. 154(b) by 0 days.

(21) Appl. No.: 16/060,328

(22) PCT Filed: Dec. 31, 2015

(86) PCT No.: PCT/IT2015/000323

§ 371 (c)(1),
(2) Date: Jun. 7, 2018

(87) PCT Pub. No.: WO2017/115389

PCT Pub. Date: Jul. 6, 2017

(65) Prior Publication Data

US 2018/0352964 A1 Dec. 13, 2018

(51) Int. Cl.

| | |
|---|---|
| ***A47C 7/42*** | (2006.01) |
| ***A47C 13/00*** | (2006.01) |
| ***A47C 17/04*** | (2006.01) |
| ***A47C 7/14*** | (2006.01) |

(52) U.S. Cl.

CPC ..... *A47C 13/005* (2013.01); *A47C 7/14* (2013.01); *A47C 7/42* (2013.01); *A47C 17/045* (2013.01)

(58) Field of Classification Search

CPC ..... A47C 13/005; A47C 13/00; A47C 7/42
See application file for complete search history.

(56) References Cited

U.S. PATENT DOCUMENTS 2,812,227 A * 11/1957 Hill ..... A47B 69/00 297/188.1
4,259,755 A * 4/1981 Hollander ..... A47C 13/005 312/111
4,293,965 A 10/1981 Hrubec
D298,186 S * 10/1988 Brannon ..... D6/336
4,985,952 A 1/1991 Edelson
5,867,849 A 2/1999 Pontrello
(Continued)

FOREIGN PATENT DOCUMENTS

CA 3007441 A1 * 7/2017 ..... A47C 7/42
DE 202015004191 U1 7/2015
(Continued)

OTHER PUBLICATIONS

International Search Report and Written Opinion for International Application No. PCT/IT2015/000323 (9 Pages) (dated Jun. 1, 2016).
(Continued)

*Primary Examiner* — Timothy J Brindley
(74) *Attorney, Agent, or Firm* — Lucas & Mercanti, LLP

(57) ABSTRACT

A convertible furniture item, configured to be transformed from a chair to a sofa, and vice-versa is provided. The furniture has a main supporting body and a first and a second supplementary body, each of which are rotatably connected to the main supporting body so that they can rotate at an angle (α) of 180 degrees with respect to such supporting body. The arrangement is such that the furniture item can assume a chair configuration and a sofa configuration.

18 Claims, 4 Drawing Sheets

(56) References Cited

U.S. PATENT DOCUMENTS

| | | | | |
|---|---|---|---|---|
| 5,893,182 | A * | 4/1999 | Sutherland | A47C 13/00 297/105 |
| 6,174,026 | B1 * | 1/2001 | Wise | A47B 85/00 108/17 |
| 7,604,290 | B1 * | 10/2009 | Giordano | A47C 3/32 220/915.2 |
| 2005/0046243 | A1 | 3/2005 | Cimino | |
| 2007/0052276 | A1 * | 3/2007 | Hurvich | A47C 13/005 297/440.14 |
| 2008/0028535 | A1 | 2/2008 | Rodrigues | |
| 2011/0309666 | A1 * | 12/2011 | Genesin | A47C 3/16 297/440.14 |
| 2013/0129405 | A1 * | 5/2013 | Everett | A47B 13/088 403/66 |
| 2017/0105532 | A1 * | 4/2017 | Becker | A47C 7/42 |
| 2017/0251815 | A1 * | 9/2017 | Garland | A47C 3/16 |
| 2018/0000244 | A1 * | 1/2018 | Nelson | A47C 1/0352 |

FOREIGN PATENT DOCUMENTS

| | | | |
|---|---|---|---|
| JP | S5314611 | U | 2/1978 |
| WO | 2008106537 | A1 | 9/2008 |

OTHER PUBLICATIONS

International Search Report and Written Opinion for International Application No. PCT/IT2015/000324 (8 Pages) (dated Jun. 1, 2016).

* cited by examiner

CONVERTIBLE FURNITURE ITEM

CROSS-REFERENCE TO RELATED APPLICATIONS

This application is a 371 of PCT/IT2015/000323, filed Dec. 31, 2015.

FIELD OF THE INVENTION

The present invention relates to a convertible furniture item capable of assuming two configurations of use, namely a chair configuration and a sofa io configuration.

BACKGROUND OF THE INVENTION

In modern furnishings, versatility and ability to change configuration are the most appreciated and desired features. In particular, there is a strong need for optimizing the occupation of space, especially in apartments and business activities having limited room availability.

Such need is felt particularly when an environment is intended for several destinations of use, for example as a living room and a dining room, and when a variable number of people should be received into it. In fact, depending upon the different destinations of use and number of people, chairs and sofas need to be alternatively put in, and removed from, the available environment.

However, moving furniture can be hard to be managed in practice. Moreover, it implies a significant waste of time and a relevant risk of damaging the furniture or the surrounding environment.

SUMMARY OF THE INVENTION

The technical problem underlying the present invention is therefore that of overcoming the drawbacks mentioned above with reference to the state of the art.

Such problem is solved by a furniture item according to claim 1.

Preferred features of the invention are recited in the dependent claims.

The furniture item of the present invention is convertible, i.e. transformable, from a chair into sofa, and vice-versa. In particular, a seating surface of the furniture item can be enlarged according to specific needs.

In the present disclosure, the term "chair" has to be interpreted in its wider meaning, to include also stools or any furniture item configured to provide a seat for a user.

Moreover, expressions like "seating surface" have to be considered as referring to surfaces capable of receiving the body of a user or a part thereof.

In general, the furniture item of the invention increases the availability of accommodation and allows optimizing the use of space.

For example, if the clients of a restaurant want to enjoy more time after the dinner, the item of the invention allows transforming the chairs into sofas, without any need for having a dedicated room for the after-dinner and for moving the clients from a room to another.

Advantageously, the convertible item according to the present invention can be adapted to different events taking place in the same environment, occupying as less space as possible.

According to particular embodiments, the invention provides a furniture item which keeps, in any configuration as a chair or sofa, comfort, ergonomics and functionality and allows high design standards in terms of aesthetic features. Advantageously, the furniture item according to the present invention is apt to be converted from chair to sofa, and vice-versa, without any substitution of parts.

BRIEF DESCRIPTION OF THE DRAWINGS

Reference will be made to the figures of the annexed drawings, wherein.

DETAILED DESCRIPTION OF PREFERRED EMBODIMENTS OF THE INVENTION

Figure 1:
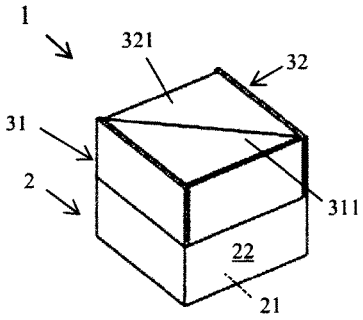
FIG. 1 shows schematically a perspective view of a convertible furniture item according to a first preferred embodiment of the present invention, in a first chair configuration.

With reference initially to FIG. 1, a first preferred embodiment of a convertible furniture item, or furniture device, is globally denoted by 1.

In FIG. 1, furniture item 1 is shown in a first configuration wherein it implements a chair (or stool). The furniture item 1 can be transformed, or converted, in a sofa. The sofa configuration is shown, for example, in FIG. 10, wherein the convertible furniture item is denoted by 1'.

With reference to FIG. 1, the furniture item 1 comprises a main supporting body 2 and a first and a second supplementary body, respectively 31 and 32.

Preferably, the supporting body 2 and/or each of the first and second supplementary bodies 31 and 32 is made of polyurethane, in particular polyurethane foam, preferably coated by fabric or leather.

The main body 2 has a substantially polyhedral shape, in particular with a square or rectangular basis. The main supporting body 2 has a bottom face 21 apt to be rested on the floor and four lateral walls, one of which denoted by way of example by 22.

Figure 11:
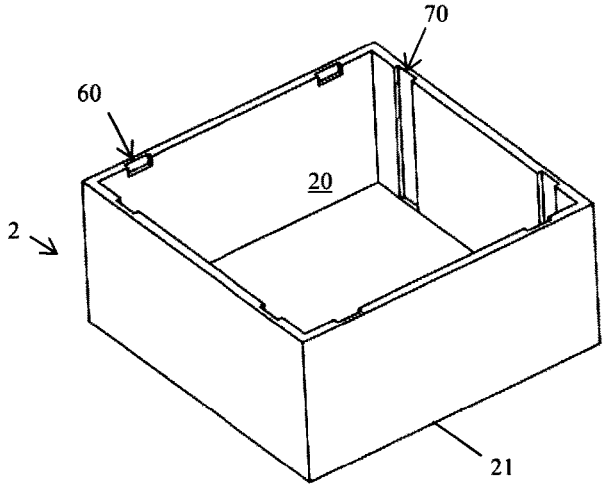
FIG. 11 shows schematically a perspective view of (a part of) a main supporting body of the furniture item of FIG. 1.

The bottom face 21 and the lateral walls 22 define an inner room 20, which is better visible in FIG. 11. The inner room 20 has a substantially polyhedral shape which reproduces internally the external shape of the main body 2. In the present example, the inner room 20 has a substantially parallelepiped or cubic shape.

As better visible in FIG. 11, the main body 2 comprises engagement means for connection, in the sofa configuration, with an extractable seating member. The latter will be introduced later on and it is shown, for example, in FIGS. 4 and 6 and therein denoted by 4.

In the present embodiment, the engagement means of the main body 2 comprises engagement grooves or seats or recesses, each denoted by 60. Still in the present example, there are provided four engagement grooves 60, which are arranged in couples at opposite sides of the main body 2, in particular at to upper end edges of two opposite lateral walls 22, at the inner face thereof.

Furthermore, the main body 2 has coupling, or guiding, means for allowing reception of the aforementioned extractable seating member 4 inside the inner room 20 when the furniture item 1 is in the chair configuration. In the present embodiment, said coupling means comprises one or more sliding slits or grooves. In the present example, there are provided four slits, each denoted by 70. The slits 70 are arranged in couples at opposite sides of the main body 2, in particular at the internal faces of two opposite lateral walls 22. More particularly, such two lateral walls 22 are those not having the engagement grooves 60.

Figure 2:
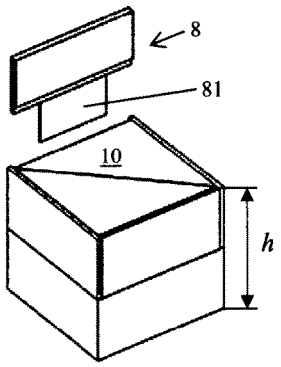
FIGS. 2 and 3 each show schematically a perspective view of the furniture item of FIG. 1 in said chair configuration and relate, in sequence, to the assembly of a seatback element.
Figure 3:
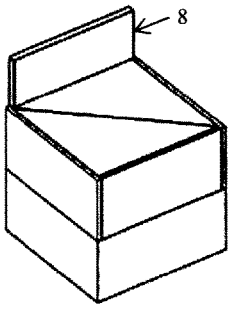

With reference to FIGS. 2 and 3, the furniture item 1 may comprise a seatback element 8 for a more comfortable sitting. Preferably, the seatback element 8 is made partly or completely of metal, preferably steel, padded and coated by fabric or leather.

Preferably, the seatback element 8 is removably connected or connectible to the main supporting body 2 and/or to one or each supplementary bodies 31 and 32.

For this purpose, the main supporting body 2 and/or one or each of said first and second supplementary bodies 31 and 32 may include receiving, or engagement, means for said seatback element 8. Such receiving means is shown by way of example in FIGS. 5A and 12 as associated with the second supplementary body 32 and therein denoted by 80. In the present example, the receiving means 80 comprises a vertical slit or guide obtained inside a lateral wall of the main body 2 or of one or both the supplementary bodies 31, 32, for the insertion of a corresponding stem or connecting element 81 of the seatback element 8.

Figure 9:
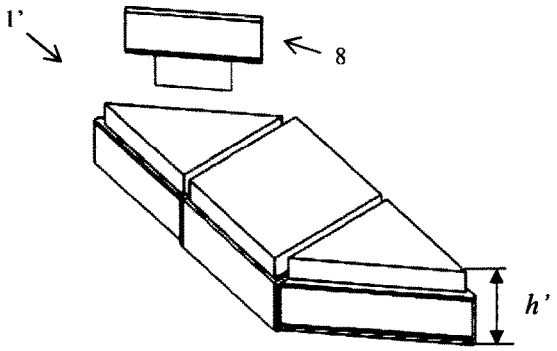
FIGS. 9 and 10 each show schematically a perspective view of the furniture item of FIG. 1 in a second sofa configuration and relate, in sequence, to the assembly of a seatback element.
Figure 10:
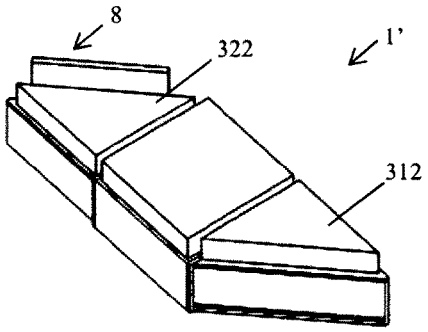

FIGS. 2 and 3 show the assembly of the seatback element 8 in the first chair configuration of the furniture item 1, while FIGS. 9 and 10 show the assembly of the seatback element 8 in the second sofa configuration of the furniture item 1.

In the present embodiment, each of said first and second supplementary bodies 31 and 32 has a substantially polyhedral shape, in particular with a triangular basis. In particular, the basis is shaped substantially as a right triangle, preferably an isosceles triangle.

Figure 4:
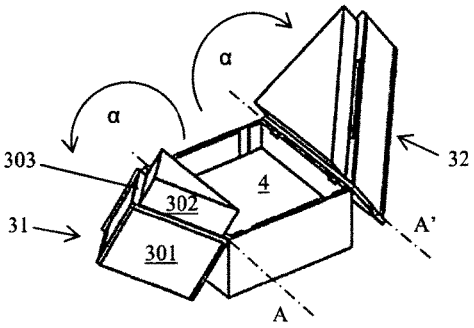
FIGS. 4, 5, and 6 to 8 each show schematically a perspective view of the furniture item of FIG. 1 and relate, in sequence, to a transformation from chair to sofa.

As shown in FIG. 4, the first and the second supplementary body 31 and 32 are each rotatably connected to the main supporting body 2 so that they can rotate of an angle $\alpha$ of substantially 180 degrees with respect to the main body 2, in particular according to respective horizontal rotation axes A and A' parallel to each other.

The first and second supplementary bodies 31 and 32 are rotatably connected each at a respective upper side edge of a lateral wall of the main body 2, in particular at opposite lateral walls thereof. In the present example, the lateral walls of such connection are those carrying the engagement means 60 of the main body 2.

Preferably, each of the first and second supplementary bodies 31 and 32 comprises a support part and a seating part one superimposed to the other. In FIG. 4, such parts are denoted by 301 and 302 for the first supplementary body 31. In the present example, the seating part 302 has a cushion construction or an upper cushion portion. Moreover, preferably the seating part 302 has a lower plant perimeter than support part 301, so that an abutment (perimetral) edge 303 of the support part 303 is provided. Such abutment edge 303 is obtained at least at the side walls of each supplementary body 31 and 32 not involved in the rotary connection with the main body 2.

Figure 12:
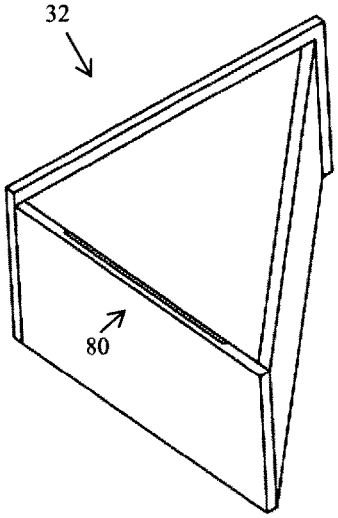
FIG. 12 shows a schematic perspective view of (a part of) a supplementary body of the furniture item of FIG. 1.

FIG. 12 shows an enlarged view of the support part 301 of the second supplementary body 32.

Figure 13:
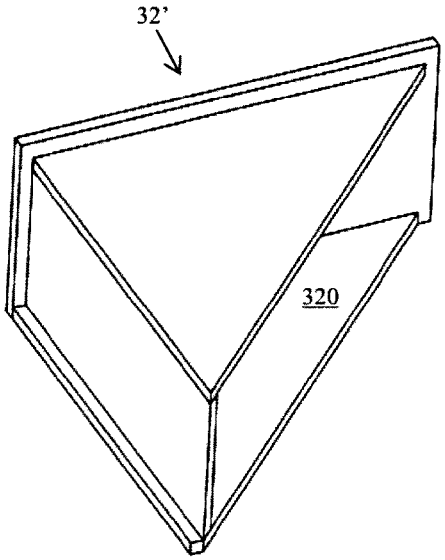
FIG. 13 shows a schematic perspective view of a supplementary body of the furniture item of FIG. 1, according to a variant embodiment with respect to that of FIG. 12.

FIG. 13 relates to an alternative embodiment of a supplementary body, herein denoted by 32', which defines an inner room 320.

As can be appreciated, in general, if the inner space of the supplementary bodies 31, 32, 32' is substantially empty, they are light and can easily be rotated to pass from one configuration to another.

The first and second supplementary bodies 31 and 32 of the present embodiment have the same shape and overall dimensions. The shape and dimensions of bodies 2, 31 and 32 of the present example allow supplementary bodies 31 and 32 to be superimposed and lay upon main body 2 when the furniture item 1 is in the chair configuration shown in FIGS. 1 to 3. In particular, in such chair configuration the seating parts 302 of supplementary bodies 31 and 32 face downwards and are preferably received (at least in part) inside the inner room 20 of the main body 2. In particular, the present arrangement is such that the hypotenuses of the triangular plant shape of the supplementary bodies 31 and 32 are superimposed to a diagonal of the square shape of the main body 2.

Moreover, in the chair configuration the abutments edges 303 of supplementary bodies 31 and 32 contact an edge of the main body 2, so that a stop of the rotation movement is obtained.

Therefore, in the chair configuration shown in FIGS. 1 to 3, the furniture item 1 realizes a compact or closed configuration, in particular a configuration of minimum encumbrance. When assuming the chair configuration, the furniture item 1 defines a chair sitting surface 10, preferably at an height h equal to about 46 cm from the floor. In particular, the chair sitting surface 10 is defined by a back face 311, 321 of each first and second supplementary bodies 31 and 32, and in particular of the support parts 301 thereof.

By rotating said first and second supplementary bodies 31 and 32 it is possible to transform the furniture item 1 from a chair to a sofa, and vice-versa.

Figure 6:
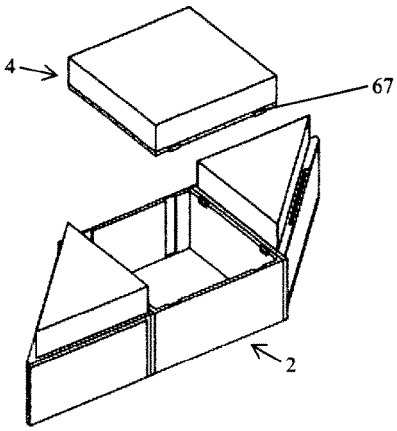

With reference to FIG. 6, extractable seating member 4 is preferably a cushion. In the present embodiment, the seating member 4 has a substantially polyhedral shape, in particular a substantial parallelepiped shape with a base corresponding to that of the inner room 20 of the main body 2.

The extractable seating member 4 includes respective engagement means for coupling with the engagement means 60 and with the coupling, or guiding, means 70 of the main body 2. In the present embodiment, the engagement means of the extractable seating member 4 are four projections or pins, applied in couples at opposite sides of member 4 and each denoted by 67.

In particular, the slits 70 of the main body 2 are configured to realize a translation guide for the above-mentioned engagement projections 67 of the seating member 4. In this way, when the furniture item 1 is to be used in the chair configuration, the seating member 4 can slide toward the bottom face 21 of the main body 2 and reach a rest configuration.

As said above, the furniture item 1 can be arranged in a sofa configuration. The passage from the chair configuration to the sofa configuration is shown in the sequence of FIGS. 4 to 10.

Figure 5:
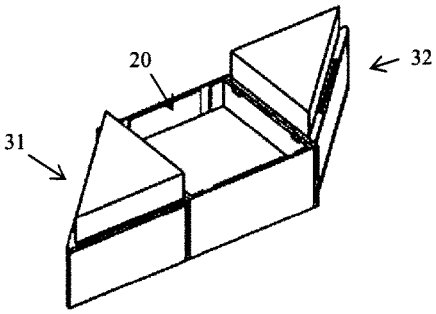
Figure 5A:
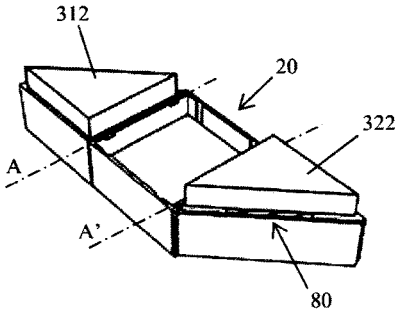
FIG. 5A shows a different perspective view of the item of FIG. 5.

After removing the seatback element 8, if present, the first and second supplementary bodies 31 and 32 can be rotated outwardly of 180 degrees with respect to the main supporting body 2 (FIG. 4) and arranged laterally adjacent thereto (FIGS. 5 and 5A). In such configuration, the seating parts 302 face upwards and the support parts 301 rest on the floor.

Figure 7:
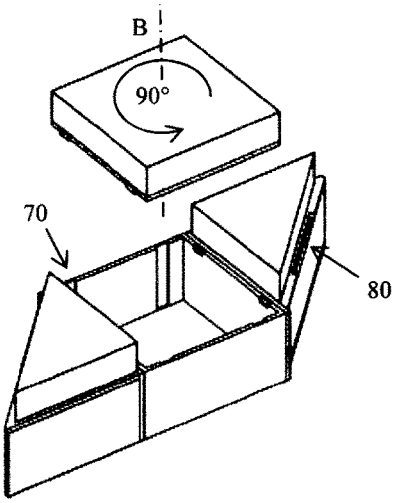
Figure 8:
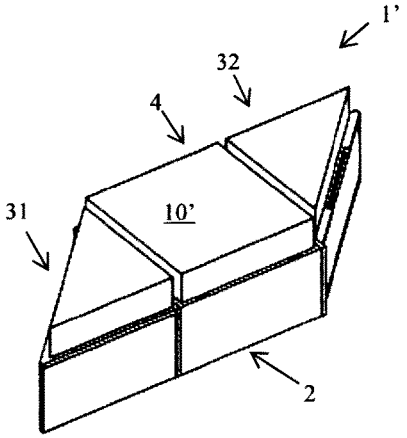

As mentioned above, the main supporting body 2 has engagement means 60 and sliding grooves 70, in pairs, at respective opposite lateral walls. The cushion member 4 is extracted from the inner room 20 (FIG. 6) and, as shown in FIG. 7, the arrangement is such that by rotating the seating member 4 of 90° about a vertical axis B after its extraction from the inner room 2, the io engagement means 60 and 67, of the main body 2 and the seating member 4, respectively, engage (FIG. 8). In this configuration, an upper surface of the seating member 4 and upper surfaces 312 and 322 of the supplementary bodies 31 and 32 define a sofa seating surface 10' which is enlarged with respect to chair sitting surface 10.

The sofa sitting surface 10' is preferably at an height h' equal to 33 cm from the floor.

Therefore, in the sofa configuration the seating member 4 is extracted from the inner room 20 and entered above the main body 2, actually closing the inner room 20 at the opposite side of the bottom face 21.

Figure 10A:
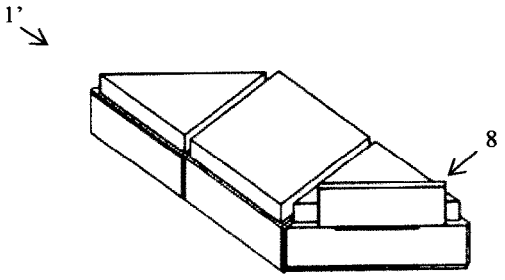
FIG. 10A shows a different perspective view of the item of FIG. 10.

As shown in FIGS. 9-10A, the furniture item 1, also in the sofa configuration, can be equipped with/use the aforementioned seatback element 8.

Two or more convertible furniture items 1 according to the present invention can be arranged adjacent, or side by side, and eventually connected to one another so as to realize a furniture assembly. In particular, it is possible to join a plurality of items 1 at respective lateral sides of the main body 2 and/or the supplementary bodies 31, 32, to enlarge the sitting surface according to number of people to be received thereon.

Figure 14:
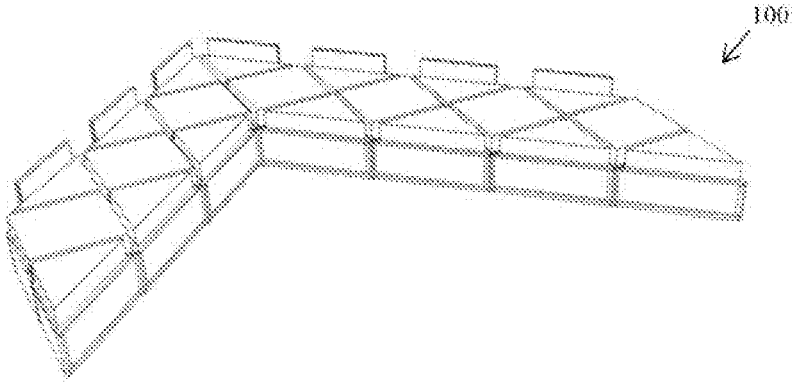
FIG. 14 shows schematically a perspective view of an embodiment of a furniture assembly comprising seven furniture items each according to to FIG. 1.

A possible embodiment for such an assembly is shown in FIG. 14 and therein denoted by 100.

Figure 15:
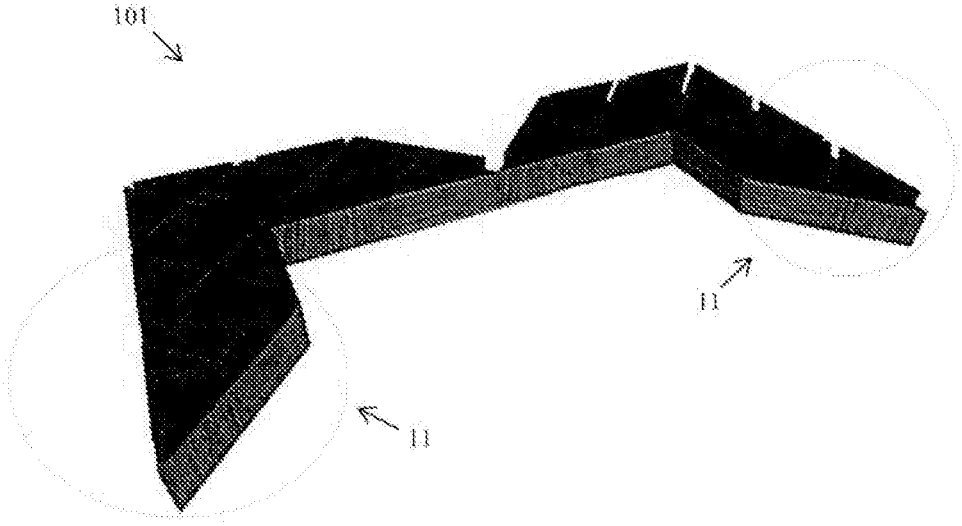
FIG. 15 shows schematically a perspective view of another embodiment of a furniture assembly comprising six furniture items according to FIG. 1 and two furniture items according to a second preferred embodiment of the present invention.

In FIG. 15, a different assembly 101 is shown which uses six furniture items 1 as that described above and two furniture items 11 according to a different embodiment, the latter being shown encircled. In such embodiment, the supplementary bodies are rotatably connected to the main body at adjacent side walls thereof instead that at opposite walls. In this way, in the sofa configuration the furniture item 11 has a triangular, or "angular", shape.

According to variant embodiments, one or more of the extraction, sliding or rotation movements described above can be motorized.

The present invention has been described so far with reference to preferred embodiments. It is intended that there may be other embodiments which refer to the same inventive concept and fall within the scope of the appended claims.

The invention claimed is:

1. A convertible furniture item, configured to be transformed from a chair into a sofa, and vice-versa, which furniture item comprises:

a main supporting body having a bottom face configured to be rested on the floor and an inner room; and a first supplementary body and a second supplementary body, each of which being rotatably connected to said main supporting body so that each of said first supplementary body and said second supplementary body can rotate of an angle of 180 degrees with respect to said main supporting body, wherein the arrangement is such that said furniture item assumes:

a first chair configuration, wherein said first and second supplementary bodies rest upon said main supporting body and define a chair sitting surface; and a second sofa configuration, wherein said first supplementary body and said second supplementary body are rotated outwardly of about 180 degrees with respect to said main supporting body and are arranged laterally adjacent to said main supporting body in such a way that said first supplementary body and second supplementary body define part of an enlarged sofa sitting surface, wherein said first supplementary body and said second supplementary body are configured to be at least partially housed inside said inner room of said main supporting body in said first chair configuration.

2. The furniture item according to claim 1, wherein said main supporting body or each of said first supplementary body and said second supplementary body have a substantially polyhedral shape.

3. The furniture item according to claim 1, wherein said main supporting body has a polyhedral shape with a square or rectangular basis.

4. The furniture item according to claim 1, wherein each of said first supplementary body and said second supplementary body has a substantially polyhedral shape with a triangular basis.

5. The furniture item according to claim 1, wherein each of said first supplementary body and said second supplementary body is rotatably connected to said main supporting body according to a respective rotation axis, such rotation axis being parallel to each other.

6. The furniture item according to claim 1, wherein said first supplementary body and said second supplementary body are rotatably connected to said main supporting body at opposite side walls of said main supporting body.

7. The furniture item according to claim 1, wherein said first supplementary body and said second supplementary body are rotatably connected to said main supporting body at adjacent side walls of said main supporting body.

8. The furniture item according to claim 1, wherein, in said first chair configuration, said chair sitting surface is defined by a back face of each of said first supplementary body and said second supplementary body.

9. The furniture item according to claim 1, wherein each of said first supplementary body and said second supplementary body comprises a support part and a sitting part superimposed one another, with the support part facing upwards in said chair configuration and the sitting part facing upwards in said sofa configuration.

10. The furniture item according to claim 9, wherein each of said first supplementary body and said second supplementary body comprises an abutment edge between said support part and sitting part so as to define a stop for an inward rotation towards said main supporting body of said first supplementary body and said second supplementary body.

11. The furniture item according to claim 1, comprising an extractable seating member configured to be housed inside said inner room of said main supporting body in said chair configuration and to be extracted therefrom in said sofa configuration.

12. The furniture item according to claim 11, wherein said main supporting body or said extractable seating member have engagement grooves or seats or recesses configured for their mutual connection in said sofa configuration.

13. The furniture item according to claim 12, wherein said main supporting body has four engagement grooves, arranged in couples at opposite side walls of said main supporting body.

14. The furniture item according to claim 11, wherein said main supporting body has one or more sliding grooves for allowing reception of said extractable seating member inside said inner room in said chair configuration.

15. The furniture item according to claim 11, wherein the overall arrangement is such that said extractable seating member is rotated 90 degrees in said sofa configuration with respect to said chair configuration.

16. The furniture item according to claim 1, comprising a seatback element, removably connected or connectible to said main supporting body or to one or each of said first supplementary body and said second supplementary body.

17. The furniture item according to claim 16, wherein said main supporting body or to one or each of said first supplementary body and said second supplementary body have a vertical slit or guide obtained inside a lateral wall of said main body or of one or both said first supplementary body and said second supplementary body, for the insertion of a corresponding stem of said seatback element.

18. A furniture assembly, comprising a plurality of furniture items, each according to claim 1.

* * * * *